US006308610B1

(12) United States Patent
Deichmann et al.

(10) Patent No.: US 6,308,610 B1
(45) Date of Patent: Oct. 30, 2001

(54) LIQUID CANNON HAVING TRUNNION ASSEMBLY

(76) Inventors: Ronald S. Deichmann; Robert L. Kuykendal, both of Waterworks Intl. Corp. 1136 Washington, St. Louis, MO (US) 63101

( * ) Notice: Subject to any disclaimer, the term of this patent is extended or adjusted under 35 U.S.C. 154(b) by 0 days.

(21) Appl. No.: 09/173,423

(22) Filed: Oct. 15, 1998

(51) Int. Cl.[7] ..... F41A 23/00
(52) U.S. Cl. ..... 89/40.01; 89/37.07; 89/41.18
(58) Field of Search ..... 89/40.01, 41.18, 89/37.07, 1.35, 37.02, 37.03, 37.04, 37.11, 37.13, 41.16; 42/65

(56) References Cited

U.S. PATENT DOCUMENTS

| | | | | |
|---|---|---|---|---|
| 1,190,356 | * | 7/1916 | Yost | 89/37.07 |
| 1,300,264 | * | 4/1919 | Hamilton | 89/41.18 |
| 1,526,341 | * | 2/1925 | Jeans | 222/79 |
| 2,094,854 | * | 10/1937 | Smith | 42/55 |
| 2,407,871 | * | 9/1946 | Cross | 89/41 |
| 2,467,514 | * | 4/1949 | Woodman | 89/41 |
| 2,475,089 | * | 7/1949 | Green et al. | 89/136 |
| 2,633,060 | * | 3/1953 | Topham et al. | 89/41 |
| 2,682,200 | * | 6/1954 | Jackson et al. | 89/41.18 |
| 2,705,298 | * | 3/1955 | Eastman | 89/41.18 |
| 2,940,466 | * | 6/1960 | Speights | 137/356 |
| 4,338,852 | * | 7/1982 | Jarvis | 89/37 |
| 4,423,663 | * | 1/1984 | Politzer et al. | 89/40 |
| 4,469,005 | * | 9/1984 | Schaulin et al. | 89/33.14 |
| 4,919,036 | * | 4/1990 | Eng | 89/37.11 |
| 5,056,409 | * | 10/1991 | Allais et al. | 89/37.01 |
| 5,480,336 | * | 1/1996 | Blanchard | 446/89 |
| 5,820,472 | * | 10/1998 | Briggs | 472/128 |
| 6,012,722 | * | 1/2000 | Petermeier et al. | 273/349 |
| 6,044,747 | * | 4/2000 | Felts | 89/40.06 |

* cited by examiner

*Primary Examiner*—Charles T. Jordan
*Assistant Examiner*—M Thomson
(74) *Attorney, Agent, or Firm*—Henry W. Cummings

(57) ABSTRACT

A trunnion assembly for mounting a launching device including a barrel for launching a liquid or a solid including at least one horizontal locating assembly to allow limited horizontal movement of the launching device; and at least one vertical locating assembly for varying the vertical inclination of the launching device. The structure for varying the extent of horizontal movement of the trunnion assembly includes at least one resilient movable stop assembly; and the structure for varying the extent of vertical movement of the trunnion assembly includes at least one resilient stop assembly.

45 Claims, 6 Drawing Sheets

LIQUID CANNON HAVING TRUNNION ASSEMBLY

I FIELD OF INVENTION

This invention relates to a Water Cannon for directing a stream of liquid at a selected direction and inclination for a selected duration, and to a unique trunnion for varying the direction and inclination of a water or other type cannon.

II BACKGROUND OF THE INVENTION

U.S. Pat. Nos. 5,160,086 and 5,641,120 disclose methods and apparatus for forming a lighted laminar flow fluid stream.

However, neither of these references disclose means for varying the direction, inclination or duration of the fluid stream.

U.S. Pat. Nos. 1,526,341; 2,759,731; 3,342,492; 3,362,713disclose water pistols and cannons used as amusement devices. But these references do not involve trunnion support.

U.S. Pat. No. 4,905,900 discloses a method and apparatus for cleaning an air conditioner with a water cannon having an air gun therein for explosively discharging a quantity of water to dislodge sludge in the air conditioner. But it is not supported on a trunnion.

U.S. Pat. No. 4,058,256 discloses a water cannon mounted on a vehicle such as an armored car with a trunnion for controlling crowds of unruly people. But this device is not at all for amusement, and does not disclose the trunnion stops to prevent undue horizontal and vertical azimuth bearing of the cannon.

U.S. Pat. No. 4,338,852 discloses a trunnion having stops to control vertical azimuth bearing of a gun and a torsion bumper stop for absorbing shock loads as the gun nears the limits of its upward and downward motion. But this not a water cannon or an amusement device.

III SUMMARY OF THE INVENTION

A. Objects of the Invention

One object of the present invention is to provide a trunnion for varying the direction and inclination of an apparatus for launching a fluid or solid.

Another object of the present invention is to provide a method and apparatus for launching a fluid stream at a selected direction and inclination.

Another object of the present invention is to provide a method and apparatus for varying the duration of the fluid stream.

Another object is to provide a water cannon amusement device.

Another object is to provide means for varying the extent of horizontal variation permitted.

Another object is to provide resilient stop means for varying the horizontal inclination of the device.

Another object is to provide means for varying the extent of vertical variation permitted.

Another object is to provide resilient stop means for varying the vertical inclination of the device.

Other objects will be apparent from the following Description and Drawings.

B. Summary

In accordance with the present invention a trunnion assembly is provided for mounting a launching device including a horizontal locating assembly 10 to provide for selected horizontal movement of the the launching device and a vertical locating assembly 80 for varying the inclination of the launching device.

In one embodiment the launching device includes an accumulator tank 24 located below the locating assemblies 10, 80, which receives a liquid such as water. A valve assembly 30 including solenoid valve 32 is in fluid communication with the accumulator tank 24. Valve assembly 30 may be electrically or pnuematically controlled by a controller 34.

A stantion assembly 40 includes a curved stand 42 having a vertical portion 43, a curved portion 45 and a horizontal portion 46. Vertical portion 43 includes a lower end portion 44 which extends into a bearing assembly 50 including a cylindrical enclosure 51 which receives cylindrical bearing 52 made of known composite bearing material, and is connected to lower end portion 44 with removable fastening means 53 such as bolt 54. Bearing 52 is movable with respect to enclosure 51 and mounting plate 55 to which is integrally connected as by welding.

A flexible conduit means 60 includes a first fluid containing conduit 61. A second flexible electrical conduit 62 carrying wires 63, and first conduit 61 are fed into lower end portion 44 and through stantion assembly 40 and extend through stand horizontal portion 46 and into a barrel assembly 70 including a cylindrical barrel 71 and through cylindrical barrel extension 72.

Pattern openings 14 (FIGS. 2–2D)are provided in base plate 55 to receive stop assemblies 20 including stop plates 21 having openings 22 to receive fasteners 23. Stops 24 are mounted vertically on stop plates 21. Resilient bumpers 25 made of elastomeric material having a Durometer value of about 60 to 100 A Scale are mounted on stops 24 with fasteners 26 which extend through respective openings 27 and 28, 28*a* in stops 24 and part way through bumpers 25. As shown in FIGS. 2E and 2F the fastener 29 may be formed integral with the bumpers, or the opening 28*a* may be threaded to receive threaded fastener 26 (FIG. 2D). Thus the extent of horizontal rotation can be varied through varied placement of stop assemblies 20 into openings 14.

The vertical locating assembly 80 fits within stand horizontal portion 46 and barrel extension 72, and as shown in FIGS. 3–6 includes a cylindrical casing 81 extending into horizontal stand portion 46 having elongated openings therein 81*a* to receive set screws 87. The extent of the elongation of openings 81*a* allows limited adjustability of the extent of vertical travel of the barrel 71. Located within casing 81 is a sleeve 82 having openings 82*a* to also receive set screws 87, which fix the location of sleeve 82. A pair of cylindrical dogs 83 and 85 each having cutaway portions 83*b* and 85*b* are located within casing 81 and are movable on shaft 86*a* extending from base 86, having a head 86*b* located within barrel extension 72 and includes openings 86*c* to receive set screws 87 which render the shaft 86*a* movable with barrel 71 about the horizontal A—A in FIG. 1.

Located within respective cutaway portion 83*b* and 85*b* are semi-cylindrical floating stops 84 and 84S made of elastomeric resilient material such as polyurethane having a Durometer value of 60 to 100 A Scale. As shown in FIG. 5 clearance 84C exists between floating stop 84 and dog 85. Similar clearance exists between floating stop 84 and dog 83.

The Flexible conduit 62 containing wires 63 extends through barrel 71 to a barrel end 73 to a light assembly 90 to light the liquid carried through flexible conduit 61 and discharged from the second end 75 of the barrel, which houses an orifice assembly 100. The light assembly 90 includes an electrical switch 91, a light bulb 92, and an activating button 93 held in place within barrel end 73 by end cap 74. At the second end 75 an orifice assembly 100 includes an orifice 105 which may have a knife edge 106. Optionally diffuser material 107 may be included to lower the Reynolds number of the liquid to create laminar flow.

IV THE DRAWINGS

V DESCRIPTION OF PREFERRED EMBODIMENTS

Figure 1:
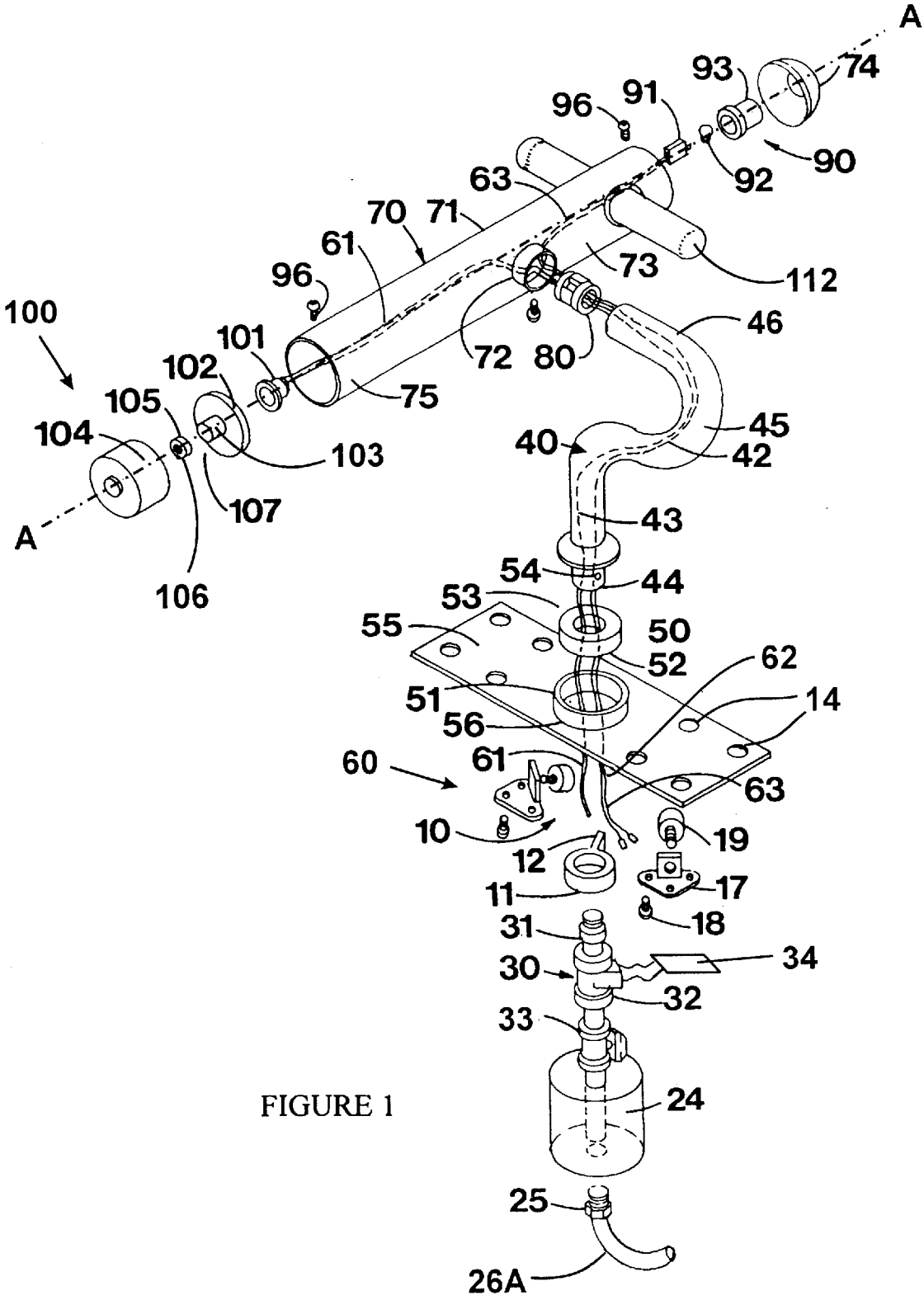
FIG. 1 is a schematic perspective view of the trunnion and water cannon apparatus of the present invention.

In accordance with the present invention a trunnion is provided for mounting a launching device including a first horizontal locating assembly 10 to provide for selected horizontal movement of the the launching device and a second vertical locating assembly 80 for varying the inclination of the launching device.

In one embodiment the launching device includes an accumulator tank 24 located below the first and second stop assemblies which receives a liquid such as water through an adapter 25 to allow for various size supply hoses.

A valve assembly 30 including for example, a solenoid valve 32 is in fluid communication with the accumulator 24. Valve assembly 30 may be electrically or pnuematically controlled by a controller 34. A second on and off valve 33 is provided which may be manually operated. Valve 32 is provided to control air pressure in the tank which may be electrically or pnuematically controlled by controller 34.

A stanchion assembly 40 includes a curved stand 42 having a vertical portion 43, a curved portion 45 and a generally horizontal portion 46. Vertical portion 43 includes a lower end 44 which extends into a bearing assembly 50 including a cylindrical enclosure 51 which receives cylindrical bearing 52 made of known composite bearing material, and is connected to stand end portion 44 with removable fastening means 53 such as bolt 54. Bearing 52 is movable with respect to enclosure 51 and mounting plate 55 to which is integrally connected as by welding.

End portion 44 extends below mounting plate 55. The first stop assembly 10 is mounted on the bottom of base plate 55, and a cylindrical stop ring 11, having an extension stop 12 integrally connected therto as by welding, is mounted on portion 44 with removable fasteners 13.

Figure 2:
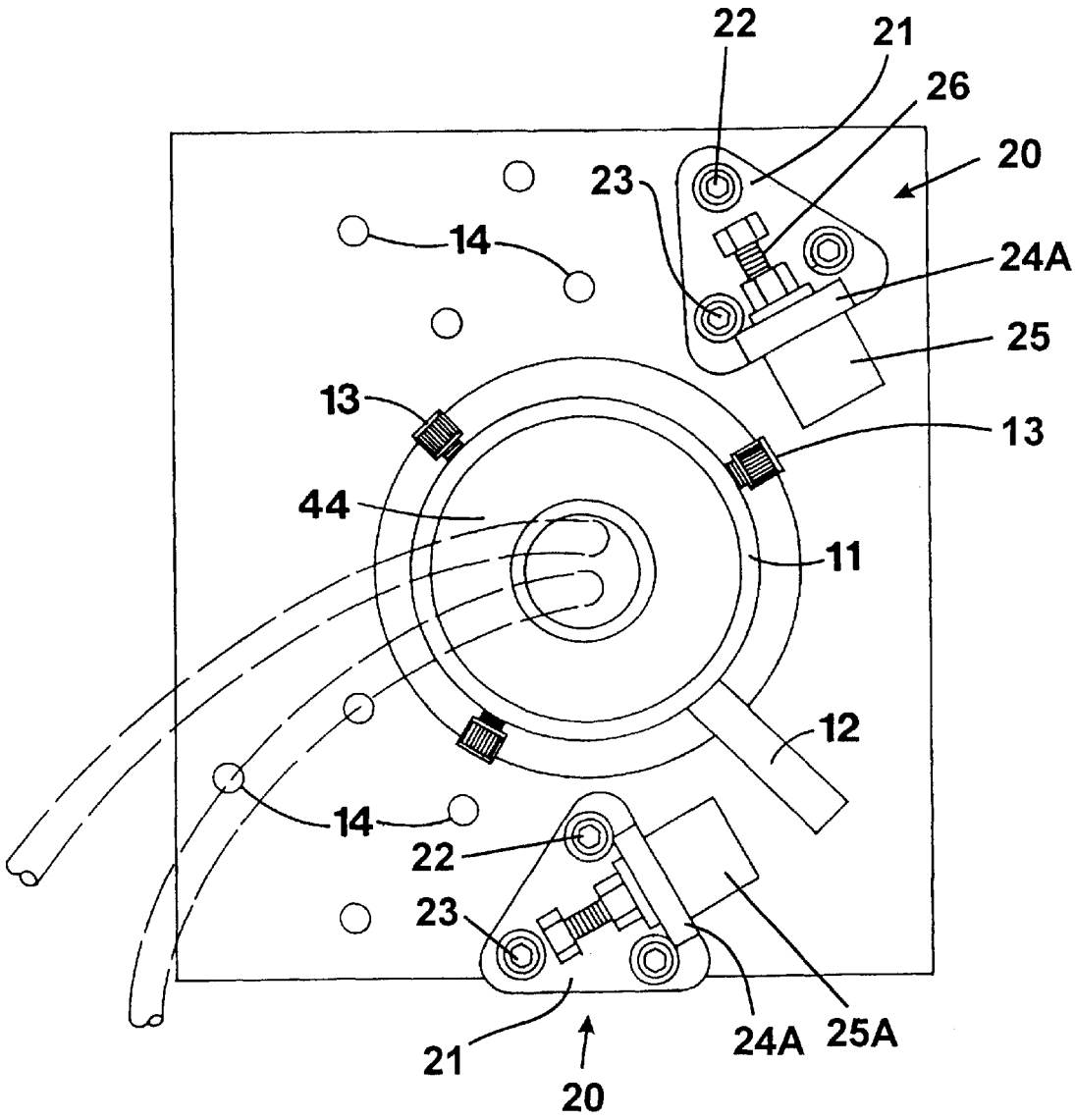
FIG. 2 is a bottom view of the horizontal location assembly of the present invention.
Figure 2A:
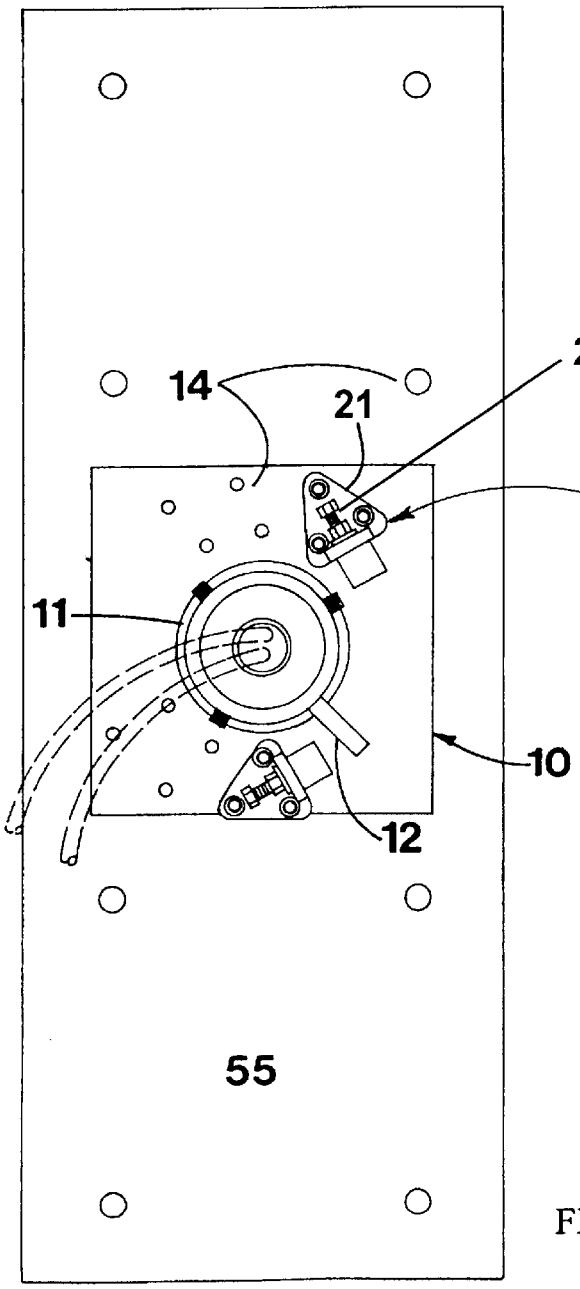
FIG. 2A is a bottom view of the horizontal location assembly and the mounting plate of the present invention.
Figure 2B:
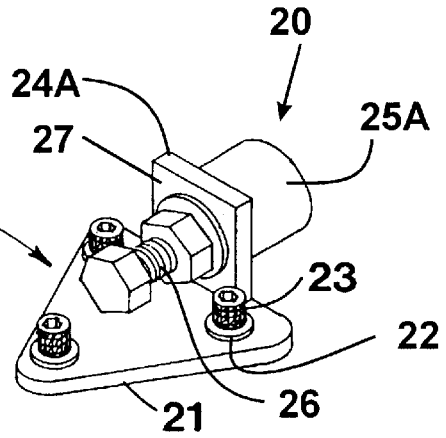
FIG. 2B is a perspective view of the horizontal location assembly of the present invention.
Figure 2C:
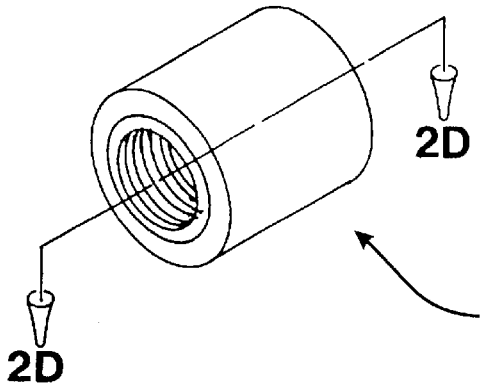
FIG. 2C is a perspective view of the horizontal location bumper of the present invention.
Figure 2D:
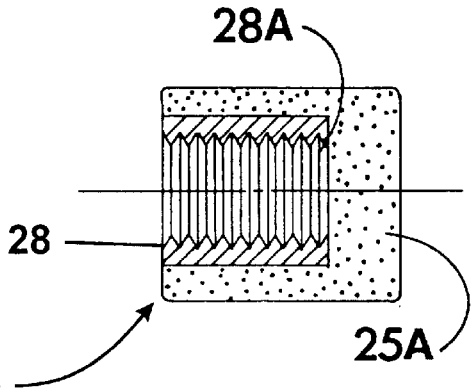
FIG. 2D is a view looking in the direction of the arrows along the line 2D—2D in FIG. 2C.
Figure 2E:
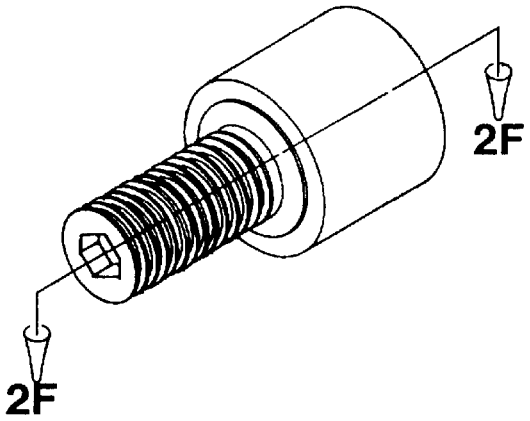
FIG. 2E is a perspective view of another embodiment of the horizontal location bumper of the present invention.
Figure 2F:
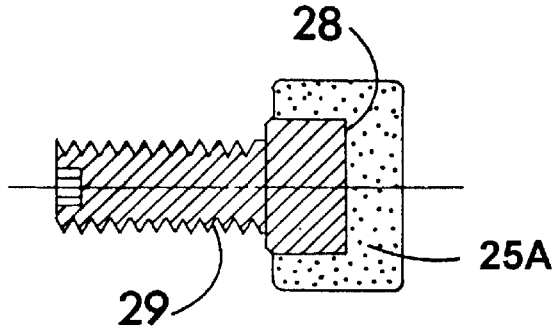
FIG. 2F is a view looking in the direction of the arrows along the line 2F—2F in FIG. 2E.

Pattern openings 14 are provided in base plate 55 to receive stop assemblies 20 including stop plates 21 having openings 22 to receive fasteners 23. Stops 24*a* are mounted vertically on stop plates 21. Resilient bumpers 25*a* made of elastomeric material having a Durometer value of about 60 to 100 A. Scale are mounted on stops 24 with fasteners 26 which extend through respective openings 27 and 28, 28*a* in stops 24*a* and part way through bumpers 25*a*. As shown in FIGS. 2E and 2F the fastener 29 may be formed interal with the bumpers, or the opening 28*a* may be threaded to receive threaded fastener 26 (FIGS. 2C and 2D). Thus the extent of horizontal rotation can be varied through varied placement of stop assemblies 20 into openings 14 in mounting plate 55.

Valve assembly 30 includes a pipe fitting 31 to which is connected a flexible conduit means 60 including a first fluid containing conduit 61. A second flexible electrical conduit 62 carrying wires 63 and first conduit 61 are fed into stancion end portion 44, through stand 42, extend through stand horizontal portion 46 and into a barrel assembly 70 including a cylindrical barrel 71 through cylindrical barrel extension 72, integrally connected to barrel 71 for example by welding.

Flexible conduit 62 containing wires 63 extends through barrel 71 to a first end 73 to a light assembly 90 to light the liquid caried through flexible conduit 61 and discharged from the second end 75 of the barrel, which houses an orifice assembly 100.

The light assembly 90 includes and electrical switch 91 connected to wires 63, a light bulb 92, and an activating botton 93 held in place within barrel end portion 73 by end cap 74, in turn held in place with removable fasteners 96. At the other end the orifice assembly 100 includes a pipe filling 101 which engages conduit 61, which is held in place with a front cover 102 with removable fastening means 103. A trim piece 104 holds in place an orifice 105 which may have a knife edge 106. Optionally diffuser material 107 may be included to lower the Reynolds number of the liquid to create laminar flow.

Figure 2G:
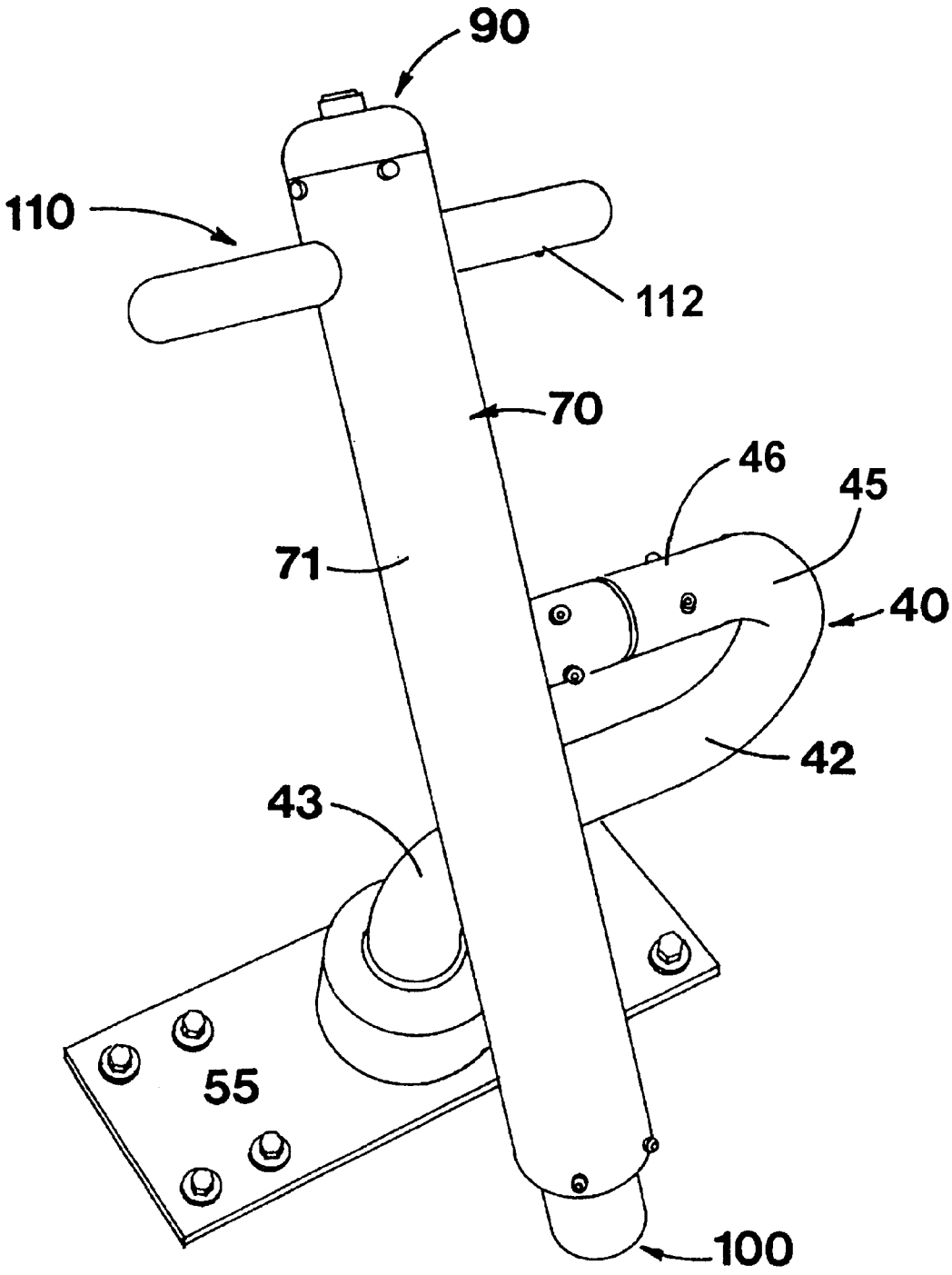
FIG. 2G is a perspective view of the vertical location assembly of the present invention.
Figure 3:
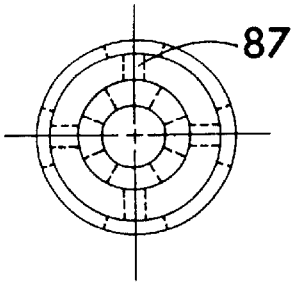
FIG. 3 is a top plan view of the vertical location assembly of the present invention.

The barren includes means 110 (FIG. 2G) for moving the launching device both vertically and horizontally, for example handles 112.

The accumulator 24 is in fluid communication with the second end 75 of the barrell through conduit 61. Water or other liquid is supplied to the accumulator 24 through the hose 26*a* and adapter 25.

The first valve means 30 is in fluid communication with the accumulator 24, which is electrically or pnuematically controlled by by controller 34 acting through wires 63 in conduit 62 extending to button 93 in light assembly 90. The light assembly 90 for activating liquid discharge is located adjacent handles 112. The duration of the time required to refill accumulator 24 may be controlled with controller 34 with an electrical connection to a supply pump 27 having graduated pump speeds to vary the accumulator refill time.

The vertical locating assembly 80 fits within stand horizontal portion 46 and barrel extension 72. As shown in FIGS. 3–6 includes a cylindrical casing 81 extending into horiziontal portion 46 having elongated openings therein 81*a* to receive set screws 87. The extent of the elongation of openings 81*a* allows limited adjustability of the extent of vertical travel of the barrel 71. Located within casing 81 is a sleeve 82 having openings 82*a* to also receive set scres 87, which fix the location of sleeve 82. A pair cylindrical dogs 83 and 85 each having cutaway portions 83*b* and 85*b* are located within casing 81 and are movable on shaft 86*a* extending from base 86, having a head 86*b* located within barrel extension 72 and includes openings 86*c* to receive set screws 87 which render the shaft 86*a* movable with barrel 71 about the horizontal A—A in FIG. 1.

Figure 5:
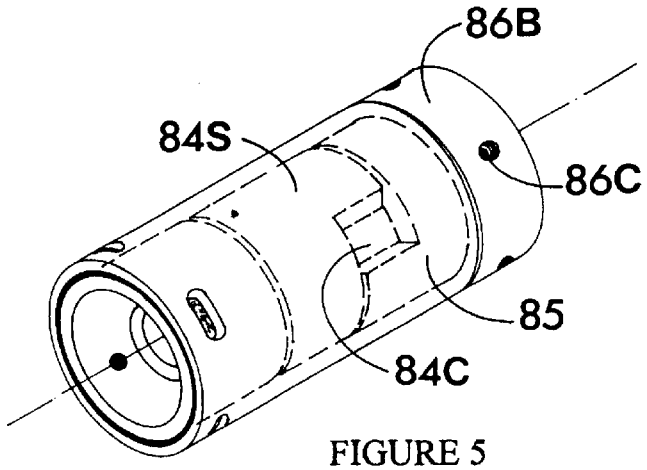
FIG. 5 is a schematic perspective view of the vertical location assembly of the present invention.
Figure 4:
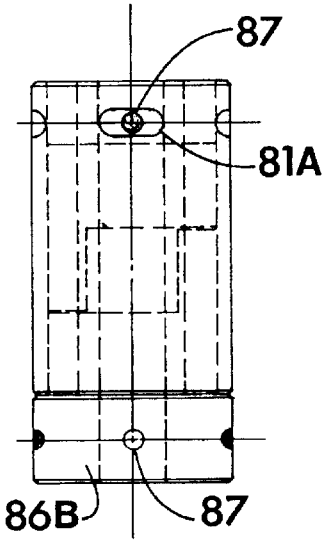
FIG. 4 is an elevation view of the vertical location assembly of the present invention.
Figure 6:
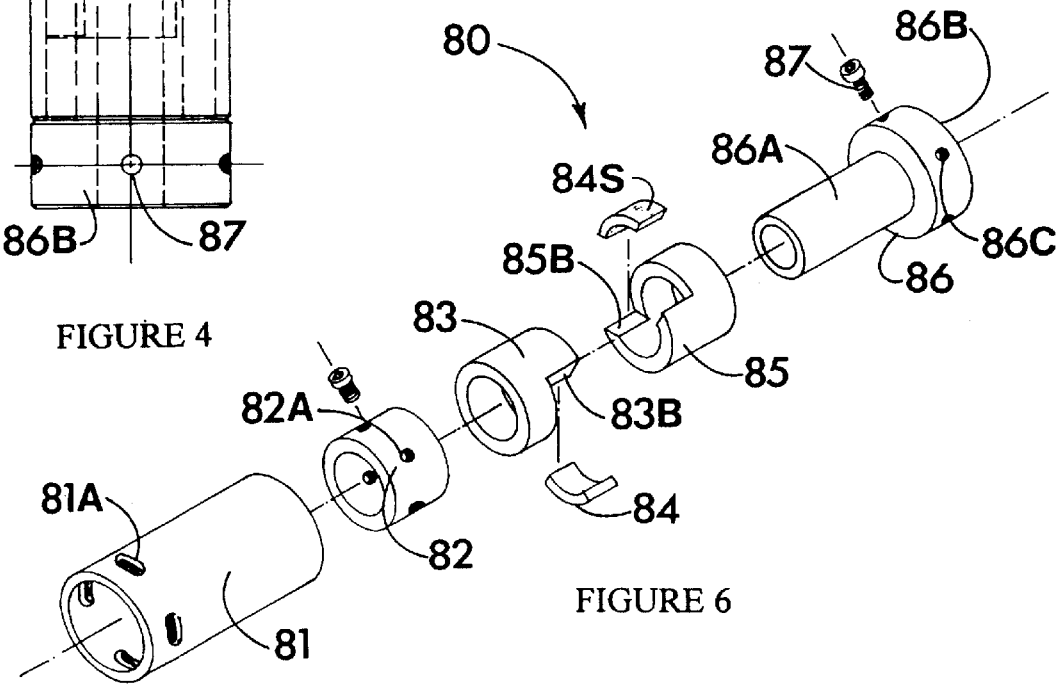
FIG. 6 is an exploded view of the vertical location stop assembly of the present invention.

Located within respective cutaway portion 83*b* and 85*b* are semi-cylindrical floating stops 84 and 84*s* made of elastomeric reilient material such as polyurethane having a Durometer of 60 to 100 A Scale. As shown in FIG. 5 clearance 84C exists between floating stop 84 and dog 85. Similar clearance exists between floating stop 84 and dog 83. This clearance allows rotation by handles 112 of barrel 71 to the extent of the clearance between floating stop 84 and dog 83 in one direction, and in the other direction, between floating stop 84*s* and dog 85. Limited variation in the extent of this clearance can be achieved by varing the location of set screws 87 in elongated openings 81*a*.

In operation, on and off valve 33 is first moved to the open position. Controller 34 is activated to fill accumulator tank 24 with liquid through hose 26 and adater 25. Air in the accumulator is compressed as the liquid enters tthe accumulator. A customer inserts a coin into the coin receiver not shown, which activates the electrical and/or pneumatic circuits for operation. The customer selects a target horizontally by using handles 112 to rotate stand portion 44 between stop assemblies 20. The customer selects a vertical orientation by using handles 112 to rotate barrel 71 about axis A—A to the extent of clearance between floating stops 84 and 84*s* relative to dogs 83 and 85. The customer then presses button 93 to activate solenoid valve 35 through wires 63 and controller 34. This causes fluid to flow from accumulator 34 through conduit 61 through stand 42, and then through barrel 71, through pipe filling 101 into orifice assembly 100 and out orifice 105. Under the control of controller 34, the liquid automatically is refiled into accumulator 24. The light bulb 92 signals when the cycle has run and the customer may make another liquid blast.

The extent of horizontal rotation can be varied by moving stop assemblies to selected pattern openings 114. The extent of vertical rotation can be varied by varying the location of set screws 87 in elongated openings 81*a*.

The horizontal locating assembly 10 and the vertical locating assembly 80 of the barrel may be used to launch a crowd control liquid such as described in U.S. Pat. No. 4,958,256; or a solid such as bullets or mortars, such as described in U.S. Pat. No. 4,338,852. Each of these patents is hereby incorporated into the present application by this reference.

What is claimed is:

1. A launching device comprising:

an accumulator located below a barrel assembly;

said barrel assembly mounted on a trunnion;

said barrel assembly including means for launching a substance selected from a liquid;

said trunnion including a horizontal locating assembly to allow for limited horizontal movement of the the launching device, comprising a resilient stop means and a vertical locating assembly for varying the inclination of said barrel assembly comprising a resilient stop means;

said barrel assembly in fluid communication with said accumulator;

conduit means for supplying liquid to said accumulator; a valve assembly in said conduit means in fluid communication with said accumulator;

control means for controlling said valve assembly; to control opening and closing of said valve assembly, and in open position allowing fluid to pass from said accumulator into said barrel assembly, and to be discharged from barrel assembly.

2. A launching device according to claim 1 wherein said valve assembly includes a solenoid valve.

3. A launching device according to claim 1 wherein said valve assembly includes a second on and off valve.

4. A launching device according to claim 1 wherein said launching device includes a stanchion assembly including a curved stand having a vertical portion, a curved portion and a horizontal portion.

5. A launching device according to claim 4 wherein said vertical portion includes a lower end portion which extends into a bearing assembly.

6. A launching device according to claim 5 wherein said bearing assembly includes a cylindrical enclosure which receives a cylindrical bearing which is connected to said end portion with removable fastening means.

7. A launching device according to claim 6 wherein said end portion extends below a mounting plate.

8. A launching device according to claim 7 wherein horizontal locating assembly is mounted on said mounting plate.

9. A launching device according to claim 7 wherein said horizontal locating assembly includes lug means mounted on said lower end portion with removable fasteners.

10. A launching device according to claim 9 wherein said lug means includes a cylindrical stop ring having an outwardly extending lug integrally connected therto.

11. A launching device according to claim 9 wherein said lug means engage stop assemblies to determine horizontal movement.

12. A launching device according to claim 11 wherein said stop assemblies include horizontal stop plates upon which stops are mounted vertically.

13. A launching device according to claim 12 wherein resilient bumpers made of elastomeric are mounted on said stops.

14. A launching device according to claim 13 wherein said elastomeric material has a Durometer value of about 60 to 100, A Scale.

15. A launching device according to claim 5 wherein said valve assembly is connected to a flexible conduit means including a first fluid containing conduit into said lower end portion, through said stand, through stand horizontal portion and into said barrel assembly.

16. A launching device according to claim 15 wherein second flexible conduit carrying electrical wires is also fed into said said lower end portion, through said stand, through said stand horizontal portion and into said barrel assembly.

17. A launching device according to claim 16 wherein said first flexible conduit extends through a barrel to a second end of the barrel, which houses a liquid orifice assembly.

18. A launching device according to claim 17 wherein said second flexible conduit extends through a barrel to a first barrel end to a light assembly to light the liquid caried into said orifice assembly and is discharged therefrom.

19. A launching device according to claim 18 wherein said light assembly includes an electrical switch connected to said electrical wires, a light bulb, a lens and a discharge activating button.

20. A launching device according to claim 18 wherein said orifice assembly includes a discharge orifice.

21. A vertical locating assembly for varying the inclination of a launching device comprising:

at least one resilient stop assembly located within a cylindrical casing;

said resilient stop assembly including a pair of cylindrical dogs, each having respective cutaway portions located within said casing and being movable on a shaft having a head located outside of said casing;

semi-cylindrical floating stops located within respective cutaway portions such that clearance exists between said floating stops and said dogs.

22. A vertical locating assembly according to claim 21 wherein said floating stops are made of elastomeric resilient material.

23. A vertical locating assembly according to claim 21 wherein said elastomeric resilient material has a Durometer value of about 60 to 100, A Scale.

24. A vertical locating assembly according to claim 22 wherein said head is located within a barrel extension extending outwardly from a launching barrel and removable fastening means are provided to render said shaft movable with said barrel about a horizontal axis.

25. A vertical locating assembly according to claim 24 wherein said resilient stop assembly extends within a horizontal stand portion which supports said barrel.

26. A trunnion assembly for mounting a launching device comprising:

a barrel for launching a substance selected from liquid, and solid;

at least one horizontal locating assembly to allow for limited horizontal movement of said launching device;

at least one vertical locating assembly for varying the inclination of said launching device;

means for varying the extent of horizontal movement of said said at least one horizontal locating assembly including trunnion assembly comprising at least one resilient movable stop assembly;

said at least one vertical locating assembly including said means for varying the extent of vertical movement of said trunnion assembly comprising at least one resilient stop assembly.

27. A launching device according to claim 26 including means for launching a solid.

28. A trunnion assembly according to claim 26 wherein said means for varying the extent of horizontal movement of said trunnion assembly comprise at least a pair of resilient movable stop assemblies mounted on a base plate.

29. A trunnion assembly according to claim 28 wherein said means for varying the extent of vertical movement of said trunnion assembly comprise at least a pair of resilient stop assemblies.

30. A trunnion assembly according to claim 29 wherein said at least a pair of pair of resilient stop assemblies are made of elastomeric material having an A Scale Durometer value of about 60 to 100.

31. A trunnion assembly according to claim 30 wherein said at least a pair of pair of resilient movable stop assemblies include stop plates and resilient bumpers.

32. A trunnion assembly according to claim 31 wherein said resilient bumpers are mounted on said stop plates.

33. A trunnion assembly according to claim 32 wherein said resilient bumpers and said stop plates include openings and removable fasteners located in said openings.

34. A trunnion assembly according to claim 33 wherein said fasteners are formed integral with said bumpers.

35. A trunnion assembly according to claim 33 wherein said resilient bumpers are threaded to receive said fastener.

36. A trunnion assembly according to claim 28 wherein the extent of horizontal rotation can be varied through selected placement of said stop assemblies on said base plate.

37. A trunnion assembly according to claim 26 wherein said means for varying the extent of vertical movement of said trunnion assembly comprise at least one resilient stop assembly located within a cylindrical casing.

38. A trunnion assembly according to claim 37 wherein said resilient stop assembly comprises a pair of cylindrical dogs, each having respective cutaway portions located within said casing and being movable on a shaft having a head located outside of said casing.

39. A trunnion assembly according to claim 38 wherein semi-cylindrical floating stops are located within said respective cutaway portions such that clearance exists between said floating stops and said dogs.

40. A trunnion assembly according to claim 39 wherein said floating stops are made of elastomeric resilient material.

41. A trunnion assembly according to claim 40 wherein said elastomeric resilient material has a Durometer value of 60 to 100, A Scale.

42. A trunnion assembly according to claim 41 wherein said head is located within a barrel extension extending outwardly from said barrel and removable fastening means are provided to render said shaft movable with said barrel about a horizontal axis.

43. A trunnion assembly according to claim 42 wherein said resilient stop assembly extends within a horizontal stand portion and said barrel extension.

44. A trunnion assembly according to claim 43 wherein a sleeve is located within said casing and means are provided to vary the extent of vertical movement about said horizontal axis.

45. A trunnion assembly according to claim 44 wherein said means to vary the extent of vertical movement about said horizontal axis comprises a sleeve having elongated openings to receive removable fasteners to allow limited adjustability of the extent of vertical travel of said barrel about said horizontal axis.

* * * * *